US005540905A

United States Patent [19]

Naito et al.

[11] Patent Number: 5,540,905

[45] Date of Patent: Jul. 30, 1996

[54] OPTICALLY ANISOTROPIC PITCH FOR MANUFACTURING HIGH COMPRESSIVE STRENGTH CARBON FIBERS AND METHOD OF MANUFACTURING HIGH COMPRESSIVE STRENGTH CARBON FIBERS

[75] Inventors: Tsutomu Naito; Takashi Hino; Masaru Miura; Kazuyuki Murakami, all of Saitama-ken, Japan

[73] Assignees: Tonen Corporation; Mitsubishi Gas Chemical Co., Inc., both of Tokyo, Japan

[21] Appl. No.: 306,222

[22] Filed: Sep. 15, 1994

Related U.S. Application Data

[63] Continuation of Ser. No. 909,539, Jul. 6, 1992, abandoned.

[30] Foreign Application Priority Data

Jul. 9, 1991 [JP] Japan ..... 3-194723

[51] Int. Cl.[6] ..... C08L 95/00

[52] U.S. Cl. ..... 423/447.6; 208/22

[58] Field of Search ..... 208/22; 423/447.6; 264/29.2

[56] References Cited

U.S. PATENT DOCUMENTS

| | | | |
|---|---|---|---|
| 4,208,267 | 6/1980 | Diefendorf et al. | 208/22 |
| 4,209,500 | 6/1980 | Chwastiak | 208/22 |
| 4,601,813 | 7/1986 | Izumi et al. | 208/22 |
| 4,655,902 | 4/1987 | Izumi et al. | 208/22 |

FOREIGN PATENT DOCUMENTS

| | | | |
|---|---|---|---|
| 0026647 | 4/1981 | European Pat. Off. . | |
| 055024A2 | 11/1981 | European Pat. Off. . | |
| 378187 | 7/1990 | European Pat. Off. | 208/39 |
| WO86/02952 | 5/1986 | WIPO . | |

*Primary Examiner*—Michael Lewis
*Assistant Examiner*—Stuart L. Hendrickson
*Attorney, Agent, or Firm*—Seidel, Gonda, Lavorgna & Monaco

[57] ABSTRACT

An optically anisotropic pitch, which is suited for manufacturing particularly high compressive strength carbon fibers in a stable fashion, with satisfactory productivity and continuously, and also a method of manufacturing high compressive strength carbon fibers using the optically anisotropic pitch.

The optically anisotropic pitch for manufacturing high compressive strength carbon fibers is composed of a benzene soluble component (BS) and a benzene insoluble component (BI) and has a Q value (i.e., weight-average molecular weight divided by number-average molecular weight) of 1.6 or below, a number-average molecular weight ratio of the benzene soluble component to the benzene insoluble component of 2.5 or below, an aromatic carbon fraction factor (fa) of 0.8 or below, a C/H atomic ratio of 1.85 or below and an optically anisotropic phase of 90% or more.

8 Claims, 1 Drawing Sheet

OPTICALLY ANISOTROPIC PITCH FOR MANUFACTURING HIGH COMPRESSIVE STRENGTH CARBON FIBERS AND METHOD OF MANUFACTURING HIGH COMPRESSIVE STRENGTH CARBON FIBERS

This is a continuation of application Ser. No. 07/909,539 filed on Jul. 6, 1992, now abandoned.

BACKGROUND OF THE INVENTION

1. Field of the Invention

This invention relates to optically anisotropic pitches which are generally suited for manufacturing high performance carbon fibers (the term "carbon fibers" being used in this specification to refer, unless particularly specified, not only to carbon fibers but also to graphite fibers) and, more particularly, to optically anisotropic pitches suited for manufacturing high compressive strength carbon fibers and a method of manufacturing high compressive strength carbon fibers using such optically anisotropic pitches.

The high compressive strength carbon fibers obtainable according to the present invention can be suitably used as reinforcement fibers for composite materials used in various industrial fields such as space and aircraft, automotive, construction and so forth industries.

2. Prior Art

In space and aircraft, automotive, construction and various other industrial fields, PAN- or rayon-based carbon fibers, which have high tensile strength and high tensile elastic modulus, for instance, have heretofore been used extensively as reinforcement fibers for light, high strength and high elasticity composite materials. These carbon fibers, however, require expensive raw materials. In addition, their carbonization yield is inferior. Therefore, they are posing various economical problems.

On the other hand, pitch-based carbon fibers, which are obtainable from petroleum pitch or coal pitch, require inexpensive raw material cost and also have high carbonization yield. For these reasons, extensive researches and investigations of this type of carbon fibers have recently been conducted. It has been said, however, that the pitch-based carbon fibers, although superior in the tensile elastic modulus to the PAN- and rayon- based carbon fibers, are inferior in the compressive strength and therefore can find only limited applications.

For the manufacture of carbon fibers, there have been proposed many optically anisotropic pitches obtainable from, for instance, petroleum pitch or coal pitch, and also many methods of producing such optically anisotropic pitches. However, there are very few proposals with the aim of improving the compressive strength of pitch-based carbon fibers. Particularly, there is substantially no proposal with the aim of the compressive strength improvement with optically anisotropic pitch.

Only Japanese Patent Application Laid-Open No. 14023/1990 shows carbon fibers excellent in the compressive strength and obtainable from a pitch with an optically anisotropic phase of 40% or below and also a method of manufacturing such carbon fibers. In this case, however, the preparation of the pitch requires a large number of steps such as hydrogenation of the material pitch, thermal treatment of the hydrogenated pitch and two-stage solvent extraction of thermally treated pitch. Therefore, it is thought that high cost of manufacture is necessary. In addition, the laid-open does not show any method of measuring the compressive strength of obtained carbon fibers, and therefore the obtainable effects are uncertain.

Japanese Patent Publication No. 4558/1979 shows optically anisotropic pitches which are obtained through sole thermal treatment. In this case, the characteristics of the optically anisotropic pitches are specified. However, although the number-average molecular weight is shown to be about 800 to 900, the molecular weight distribution is thought to be considerably broad, because of the manufacture through the sole thermal treatment. Therefore, with the disclosed optically anisotropic pitches it is impossible to expect improvement of the compressive strength of carbon fibers.

Japanese Patent Publication No. 57715/1989 shows specification of the molecular weight distribution of optically anisotropic pitch. However, since the molecular weight distribution can not be sufficiently controlled, there is no guarantee for improvement of the carbon fiber compressive strength. Further, concerning examples disclosed in the publication, the yield of optically anisotropic pitch is low, and the softening points of obtained optically anisotropic pitches are high.

As shown, with the optically anisotropic pitches obtainable by the prior art thermal treatment process, limitations are imposed on the ranges of control of the composition, number-average molecular weight, molecular weight distribution and so forth. Therefore, it is impossible to obtain an optically anisotropic pitch, which is suited for manufacturing high compressive strength carbon fibers as according to the present invention.

Aside from the thermal treatment process, the solvent extraction process may permit control of the composition, number-average molecular weight, molecular weight distribution, etc. of the pitch. However, in order to more accurately control and specify these characteristics, it is necessary to specify the material.

In the prior art solvent extraction processes, no material is specified. Therefore, the obtainable optically anisotropic pitches have different characteristics from those of the optically anisotropic pitch, which is suited for manufacturing the high compressive strength carbon fibers as according to the present invention.

SUMMARY OF THE INVENTION

The inventors have conducted extensive researches and investigations and found that it is possible to obtain high compressive strength carbon fibers without spoiling the tensile strength and tensile elastic modulus particularly from an optically anisotropic pitch having an adequate number-average molecular weight and a narrow molecular weight distribution characteristics. The present invention is predicated in this finding.

An object of the invention, accordingly, is to provide an optically anisotropic pitch, which is particularly suited for manufacturing high compressive strength carbon fibers in a stable fashion, with satisfactory productivity and continuously, and a method of manufacturing high compressive strength carbon fibers using this optically anisotropic pitch.

To attain the above object of the invention, there is provided an optically anisotropic pitch for manufacturing high compressive strength carbon fibers, which optically anisotropic pitch contains a benzene soluble component and a benzene insoluble component and has a Q value (weight-average molecular weight/number-average molecular weight) of 1.6 or below, a number-average molecular weight ratio of the benzene insoluble component to the benzene soluble component of 2.2 or below, an aromatic carbon fraction (fa) of 0.8 or above, a C/H atomic ratio of 1.85 or below and an optically anisotropic phase of 90% or above.

As noted above, the inventors, as a result of extensive researches and investigations, have found that high compressive strength carbon fibers are obtainable from an optically anisotropic pitch having an adequate number-average molecular weight and a narrow molecular weight distribution range.

More specifically, as a result of researches and experiments conducted with respect to the specification of optically anisotropic pitches for improving the compressive strength of carbon fibers, it has been found that it is important as the characteristics of the optically anisotropic pitch that:

(1) the number-average molecular weight is in an adequate range and small;

(2) both low and high molecular weight components are less contained, and the molecular weight distribution range is narrow;

(3) the aromatic carbon fraction is high; and (4) the quinoline insoluble component is less contained, and the viscosity and softening point are comparatively low. By spinning and carbonizing optically anisotropic pitches having such characteristics, it is possible to obtain high compressive strength carbon fibers. Presumably, this is attributable to the adequate number-average molecular weight and narrow molecular weight distribution range of the optically anisotropic pitch. It is thought that with such optically anisotropic pitch the crystal structure of carbon fibers that are obtained has a narrow crystal size range, thus leading to an improvement of the compressive strength with respect to the tensile elastic modulus.

DETAILED DESCRIPTION OF THE INVENTION

Figure 1:
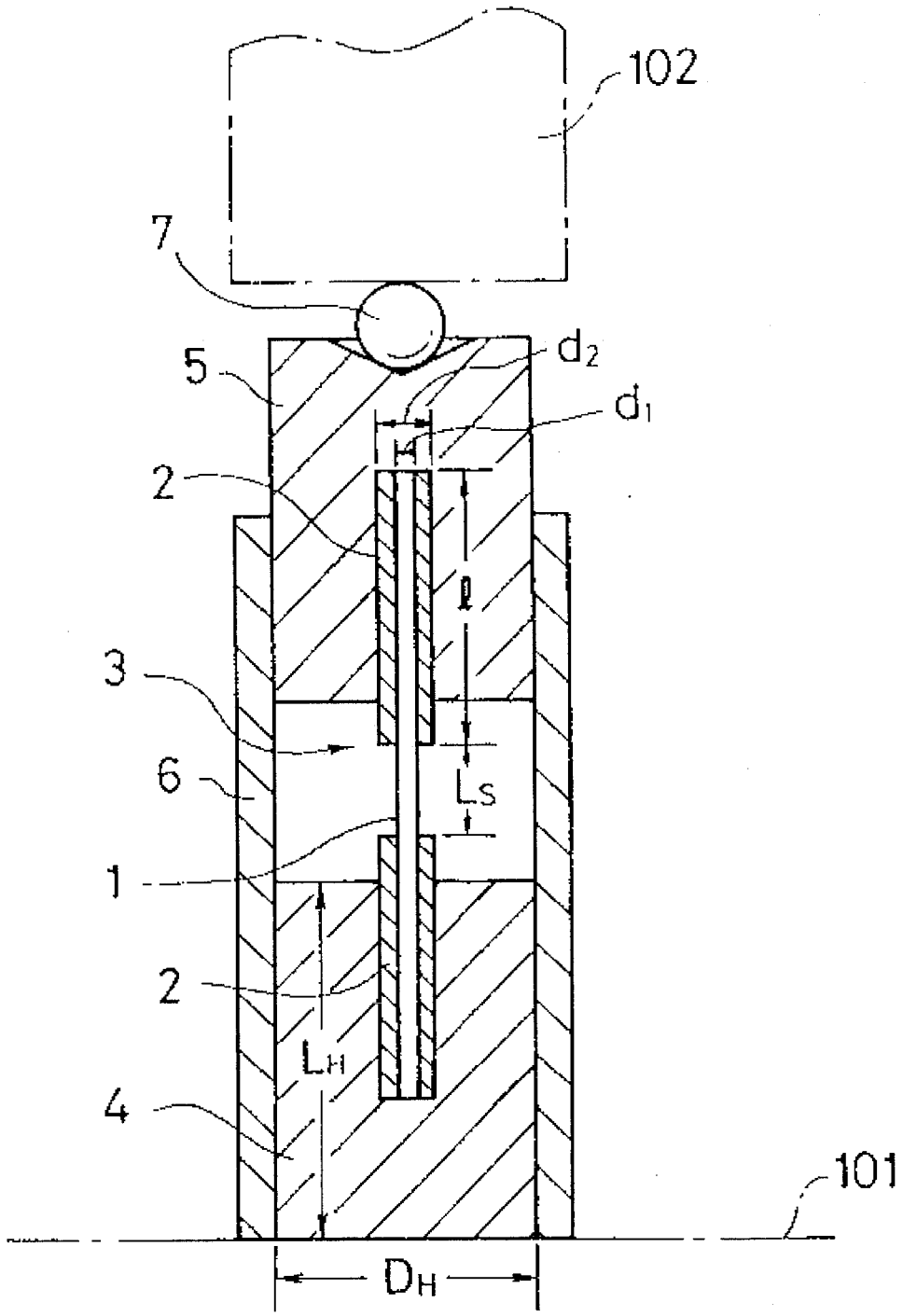
FIG. 1 is a sectional view showing a strand compression testing machine.

To specify the optically anisotropic pitch with respect to the characteristics (1) and (2) noted above, the inventors have introduced the concepts of the Q value (weight-average molecular weight/number-average molecular weight) and the number-average molecular weight ratio of a benzene insoluble component (BI) to a benzene soluble component (BS). Further description will now be made with respect to these concepts.

Regarding the benzene insoluble component and quinoline insoluble component according to the invention, by charging powdery pitch into a cylindrical filter with a mean pore diameter of 1 μm, a portion obtainable by thermal extraction from the pitch with benzene for 20 hours and insoluble to benzne, is referred to as the benzene insoluble component, and a portion separated from the pitch by a centrifugal method (JIS K-2455) using quinoline as a solvent is referred to as the quinoline insoluble component.

The "Q value" noted above is the division of the weight-average molecular weight by the number-average molecular weight and serves as a measure of the spread of molecular weights. It is 1.0 with a pure material and is increased with increasing molecular weight distribution range.

Regarding the benzene soluble and insoluble components (BS) and (BI) of the optically anisotropic pitch according to the invention, the Q values of the benzene insoluble and soluble components (BI) and (BS) were determined from the weight and number-average molecular weights determined by measuring the molecular weight distribution by GPC (gel permeation chromatography), and also the Q value of the whole pitch was calculated from the molecular weight distributions and yields of the benzene insoluble and soluble components (BI) and (BS).

As a result of investigations conducted by the inventors, it has been found that carbon fibers manufactured with an optically anisotropic pitch having a reduced Q value have an increased compressive strength.

According to this invention, the Q value of the pitch is 1.6 or below, preferably 1.5 or below. With a Q value exceeding 1.6, it is no longer possible to expect substantial improvement of the compressive strength of carbon fibers manufactured from this pitch. The concept of the number-average molecular weight of the benzene insoluble component (BI) to the benzene soluble component (BS), used for specifying the optically anisotropic pitch according to the invention, may not be usual, but is an important factor for specifying the optically anisotropic pitch according to the present invention.

Regarding the benzene insoluble and soluble components (BI) and (BS) according to this invention, the number-average molecular weights of these components are measured using a VPO (vapor pressure osmometer), and the number-average molecular weight ratio of the benzene insoluble component (BI) to the benzene soluble component (BS) is used as a measure. Usually, the number-average molecular weight of the benzene insoluble component (BI) is greater than that of the benzene soluble component (BS). Thus, if the ratio is large, it means a large difference between the number-average molecular weights of the benzene insoluble and soluble componets (BI) and (BS) as the components of the pitch. Conversely, a small ratio means a small difference between the number-average molecular weights of the benzene insoluble and soluble components (BI) and (BS). In other words, smaller ratio means less contents of low and high molecular weight components, that is, narrower molecular weight distribution range.

According to investigations conducted by the inventors, to obtain high compressive strength carbon fibers the number-average molecular weight ratio of the benzene insoluble component (BI) to the benzene soluble component (BS) of the optically anisotropic pitch is 2.2 or below, preferably 2.0 or below. If the ratio exceeds 2.2, it is no longer possible to expect substantial improvement of the compressive strength of carbon fibers manufactured from this optically anisotropic pitch.

The aromatic hydrocarbon content, i.e., the aromatic carbon fraction (fa), used for the specification of optically anisotropic pitch according to the present invention, represents the ratio of carbon atoms of the aromatic structure to all the carbon atoms as measured by a carbon and hydrogen content analysis and an infrared absorption spectroanalysis. The planar structural characteristic of a molecule is determined by the size of condensed polycyclic aromatic hydrocarbon molecule, number of naphthene rings, number and length of side chains and so forth. Thus, the planar structural characteristic of molecule may be considered with the aromatic carbon fraction (fa) as an index. More specifically, the aromatic carbon fraction (fa) is the higher the more the condensed polycyclic aromatic hydrocarbons, the less the number of naphthene rings, the less the number of paraffinic side chains, and the smaller the side chain length. Thus, the greater the aromatic carbon fraction (fa), the higher the planar structural characteristic of molecule. The method of measurement and calculation with respect to the aromatic carbon fraction (fa) is based on Kato's method (Kato et al, *Journal of the Fuel Society of Japan,* 55, 244, 1976).

According to the invention, the aromatic carbon fraction (fa) is 0.8 or above, preferably 0.8 to 0.9. If the aromatic carbon fraction (fa) is less than 0.8, the planar structural characteristics of molecule is small, and it is no longer possible to expect substantial improvement of the compressive strength of carbon fibers manufactured from this optically anisotropic pitch.

The C/H atomic ratio is used together with the aromatic carbon fraction (fa) as an index for determining the planar structural characteristics of the pitch molecule. The greater the C/H atomic ratio, the greater the planar structural characteristic of molecule. Excessive increase of the C/H atomic ratio, however, results in reduction of the fluidity of the fluid at a certain temperature and also increase of the softening point, although the planar structural characteristic of the pitch molecule is increased. According to the invention, the C/H atomic ratio is 1.85 or below, preferably 1.55 to 1.80. If the C/H atomic ratio exceeds 1.85, the softening point is increased although the planar structural characteristic of molecule is improved. If the C/H atomic ratio less than 1.55, on the other hand, the planar structural characteristic of molecule is reduced, making it impossible to expect substantial improvement of the compressive strength of carbon fibers obtainable from this optically anisotropic pitch.

The softening point of the optically anisotropic pitch according to the invention is 320° C. or below. This softening point is the value of the Mettler softening point conforming to ASTM D-3104.

The optically anisotropic phase of the optically anisotropic pitch according to this invention is 90% or above, preferably substantially 100%. A substantially non-homogenious optically anisotropic pitch with an optically isotropic phase of 10% or above, is an obvious mixture of two phases, i.e., an optically anisotropic phase of high viscosity and an optically isotropic phase of low viscosity. This means that a mixture of pitches of different viscosities is spun. In such case, it is difficult to obtain stable spinning. In addition, since the optically isotropic phase is contained, it is difficult to obtain sufficient tensile strength and elastic modulus. Consequently, high performance carbon fibers can not be obtained.

The "optically anisotropic phase" according to the invention is one of the pitch components. That is, it is an optically anisotropic portion, of which a polished section of a pitch mass having been solidified at the neighborhood of room temperature permits a luminance to be recognized with a reflecting polarizing microscope by rotating a crossed nicol. On the other hand, a pitch portion which does not permit recognition of any luminance, i.e., an optically isotropic phase portion, is referred to be optically isotropic. The optically anisotropic phase according to the invention is thought to be the same as commonly termed meso-phase. The meso-phase is of two different kinds, one being insoluble to quinoline or pyridine, the other one greatly containing components soluble to quinoline or pyridine. The optically anisotropic phase according to the invention is principally the latter meso-phase.

The content of the optically anisotropic phase according to the invention is determined by measuring the area ratio of the optically anisotropic phase in a sample through observation photography of the sample with a polarizing microscope under the crossed nicol.

The compressive strength of carbon fibers according to the invention is measured by a method disclosed in Japanese Patent Application No. 29628/1991. The method of measurement will now be briefly described with reference to FIG. 1.

A test fiber tow comprising a predetermined number of (about 3,000) filaments under a predetermined tension is impregnated with an epoxy resin solution. The test fiber tow impregnated with resin, i.e., strand, is taken up on a hardening frame or winder. The test strand is heated in a oven to be cured while it is held straight. The cured strand is cut to a length of 300 mm. The cut strand has a circular section with a diameter of 1 mm and contains 60% by volume of carbon fibers.

Then, a metallic cylindrical tab 2 is bonded to each end portion of the cut strand 1 using an epoxy type adhesive to produce a test piece 3. The tab 2 is formed of a stainless steel pipe having a length (1) of 30 mm, an inner diameter (d1) of 1 mm and an outer diameter (d2) of 3 mm. The exposed strand portion (Ls) of the test piece 3 is set to 5 mm.

Opposite end portions of the test piece 3 thus produced are then mounted in a lower and an upper holder 4 and 5, respectively, which are then inserted into and mounted in a cylindrical sleeve 6. The holders 4 and 5 are made of stainless steel and have an outer diameter (DH) of 15 mm and a length (LH) of 40 mm. The cylindrical sleeve 6 is made of stainless steel.

The test set-up thus assembled is set on a table 101 of a material testing machine, and a compressive load is applied to the test piece 3 from a cross-head 102 of the material testing machine via a point load application ball 7 and the upperholder 5. The speed of movement of the cross-head 102 is set to 1 mm/min.

The compressive strength ($\sigma_c$) of the strand is calculated from the maximum load applied in the above compression test using an equation $$\begin{aligned}\sigma_c &= P/A_f \times 0.6 \\ &= (Pmax + w) \times \rho/T \times 1{,}000 \times 0.6\end{aligned} \quad (1)$$

where P is the total load (kg), Pmax is the maximum load (kg), w is the weight (kg) of the upper tool, $A_f$ is the total sectional area ($mm^2$) of the fibers, ρ is the density ($g/cm^3$) of the fibers, and T is the texture (mg/m) of the fibers. All the values of the compressive strength in the present specification mean the compressive strength of the strand.

With the above method of compressive strength measurement, it is possible to obtain substantially the same results of measurement as those, which are obtainable with such prior art method as ASTM D3410 (Celanese method, IITRI method), in a short period of time, accurately and with satisfactory reproducibility.

Now, the method of manufacturing optically anisotropic pitches according to the invention will be described.

While conducting researches concerning the optically anisotropic pitch having the characteristics noted above according to the invention, the inventors have found that the optically anisotropic pitch having such chracteristics, although they may be manufactured by any method, are obtainable from, for instance, aromatic hydrocarbons as material by suitably controlling the conditions of polymerization or from a specific material pitch by removing low molecular weight component through solvent extraction or reduced pressure distillation.

Now, a suitable method of manufacturing a product optically anisotropic pitch will be described, which uses as the material pitch a pitch principally composed of an optically isotropic phase having specific composition and characteristic, and in which the optically isotropic phase is produced and recovered by removing low molecular weight components through solvent extraction or by removing low molecular weight components through reduced pressure distillation under specific conditions, under which polycondensation reaction does not substantially take place.

The material pitch used is principally composed of an optically isotropic phase, which contains 80% by weight or above (preferably 85% by weight or above) of an n-heptane insoluble component, 10% by weight or above (preferably 20% by weight or above) of a benzene insoluble component and 5% by weight or below (preferably 1% by weight or below) of a quinoline insoluble component and has an aromatic carbon fraction (fa) of 0.75 or above (preferably 0.8 or above) and a softening point of 280° C. or below.

The n-heptane-, benzene- and quinoline-insoluble components according to the invention are as follows. The n-heptane insoluble component is a portion, which is obtained by charging powdery pitch into a cylindrical filter having a mean pore diameter of 1 μm and carrying out thermal extraction with n-heptane for 20 hours using a Soxhlet extractor, the component being free from any n-heptane soluble component. The benzene insoluble component is a portion, which is obtained through thermal extraction with benzene for 20 hours, the component being free from any benzene soluble component. The quinoline insoluble component is a portion, which is separated by a centrifugal process (JIS K-2455) with quinoline used as a solvent.

The softening point of the material pitch refers to the solid-liquid transition temperature of the pitch. It is the value of the Mettler softening point conforming to ASTM D-3104.

The material pitch will be further described. If the n-heptane insoluble component in the material pitch is insufficient, a great amount of low molecular weight components have to be removed. This leads to low yield, which is inefficient. Accordingly, the content of the n-heptane insoluble component is 80% by weight or above. If the n-heptane insoluble component is excessively contained, it is liable to increase the softening point and viscosity of the obtainable optically anisotropic pitch. Therefore, the content of the n-heptane insoluble component is suitably 95% by weight or below.

Further, since the quinoline insoluble component is contained by 5% by weight or below in the material pitch, the benzene insoluble component therein substantially means a component, which is insoluble to benzene but soluble to quinoline. This component constitutes nuclei of the optically anisotropic phase. Thus, the benzene insoluble component is suitably contained as much as possible in a range permissible in view of the softening point, viscosity and so forth. The more this component, the readier is the generation of the optically anisotropic phase. If the benzene insoluble component is 10% by weight or below, the generation of the optically anisotropic phase is difficult, and also it is necessary to remove a great amount of low molecular weight components, which is inefficient. Further, the component which is insoluble to benzene and soluble to quinoline, is usually not fused when heated alone, for fusing the optically anisotropic pitch, therefore, the benzene soluble component is suitably contained. Thus, the content of the benzene insoluble component is suitably 85% by weight or below. In addition, the benzene soluble component and n-heptane insoluble, benzene-soluble component, although they are not independently optically anisotropic, have to be contained in order to provide the optically anisotropic pitch having a viscosity suited for the spinning.

The quinoline insoluble component in the material pitch is also a component serving as nuclei of the optically anisotrtopic phase. However, its molecular weight is higher than that of the benzene insoluble, quinoline soluble component. Therefore, for obtaining an optically anisotropic pitch capable of stable spinning at a low temperature, it is desirably not contained at all or contained by as small amount as possible in the material pitch. If the quinoline insoluble component exceeds 5% by weight, the obtainable optically anisotropic pitch has increased softening point and viscosity to increase the spinning temperature and also deteriorate the spinning property. Pitches which do not contain high molecular weight quinoline insoluble component, are preferred in that the permissible range of removal of low molecular weight components is extended. The extent of removal of low molecular weight components influences the softening point, viscosity and so forth of the optically anisotropic pitch, and it permits control to a certain extent of the property of pitch fibers to be rendered infusible.

Further, if the aromatic carbon fraction (fa) of the material pitch is low, it is difficult to obtain an optically anisotropic pitch. Thus, the aromatic carbon fraction (fa) is suitably high, i.e., 0.75 or above, preferably 0.8 or above. However, if it is excessively high, the softening point, viscosity and so forth become excessively high. Therefore, usually it is suitably 0.9 or below.

The softening point of the material pitch is suitably low in order that the obtainable optically anistotropic pitch may be stably spun at low temperature. Thus, it is 280° C. or below. However, if the obtainable optically anistotropic pitch has a somewhat high softeningpoint, pitch fibers may be satisfactorily rendered infusible. Therefore, usually the softening point is suitably 190° C. or above.

The pitch principally composed of the optically anisotropic phase having the above specific composition and characteristic, may be prepared from a starting material containing condensed polycyclic aromatic hydrocarbons or from aromatic hydrocarbons in:

(a) a method, in which the intended pitch is obtained through thermal treatment or by catalytic polymerization;

(b) a method, in which an optically isotropic pitch is obtained through thermal treatment or catalytic polymerization and then the intended pitch is obtained through solvent extraction or reduced pressure distillation;

(c) a method, in which a pitch containing the optically anisotropic phase is obtained through thermal treatment or catalytic polymerization and then the intended pitch is obtained by removing the optically anistotropic phase through specific gravity difference separation; and (d) a method, in which a pitch containing the optically anisotropic phase is obtained through thermal treatment or catalytic polymerization and the intended pitch is obtained by removing the quinoline insoluble component through solvent extraction.

The above methods (a) to (d) of preparation of a pitch principally composed of the optically isotropic phase are by no means limitative.

From the pitch thus obtainable, principally composed of the optically isotropic phase having a specific characteristic, an optically anisotropic phase is generated by removing low molecular weight components by a solvent extraction process or by removing low molecular weight components through reduced pressure distillation under specific conditions, under which thermal polycondensation reaction does not substantially take place.

When generating the optically anisotropic phase by removing low molecular weight components through solvent extraction, the material pitch is pulverized, and 10 to 100 parts of a solvent is added for dilution to 1 part of the material pitch. In this case, the operation can be carried out under normal pressure or an increased pressure and at room temperature or an elevated temperature.

In examples to be described hereinunder, a blend organic solvent composed of n-heptane and benzene is used. However, this solvent is by no means limitative, and it is possible to use various other solvents as well so long as they permit generation of optically anisotropic phase from solvent insoluble pitch through extraction and separation of low molecular weight components in the material pitch.

For example, it is possible to use a sole organic solvent such as benzene, toluene, xylene and methyl ethyl ketone. These organic solvents may also be used as blend solvents with such organic solvents as n-heptane, n-hexane and acetone.

The solvent extraction process permits, with appropriate selection of the solvent used and, if necessary, the blending ratio of solvents when a blend solvent is used, an intended optically anisotropic pitch with substantially 100% optically anisotropic phase by removing low molecular weight molecules through sole solvent extraction or by obtaining a pitch containing 20 to 70% of an optically anisotropic phase and recovering the optically anisotropic phase.

When carrying out the removal of low molecular weight components and the generation of the optically anisotropic phase, the reduced pressure distillation is carried out substantially in a temperature range, in which thermal cracking-polycondensation reaction of the pitch does not take place, and also under a high vacuum. More specifically, the reduced pressure distillation is carried out at a temperature of 400° C. or below, preferably 370° C. or below, and under a pressure of 100 mm Hg or below, preferably 1.0 mm Hg or below. Through this treatment, an optically anisotropic pitch substantially composed of 100% optically anisotropic phase can be obtained by appropriately selecting the characteristic of the material pitch. Preferably, however, the optically anisotropic phase is recovered after obtaining a pitch containing 20 to 70% of an optically anisotropic phase. In this way, an intended optically anisotropic pitch with substantially 100% optically anisotropic phase can be obtained.

Now, a method of recovering a substantially 100% optically anisotropic phase pitch from a pitch containing 20 to 70% of an optically anisotropic phase, will be described.

As the method of recovery, various well-known processes may be adopted. Particularly, it is suitable to adopt a process of separation utilizing the specific gravity difference, for instance a method disclosed in Japanese Patent Publication No. 38755/1986 and also Japanese Patent Publication No. 24036/1987. More particularly, for production on the industrial bases it is suitable to adopt a centrifugal separation process.

In the centrifugal separation process, a pitch generated as a result of a thermal treatment and containing the optically anisotropic phase, is subjected to an operation of centrifugal separation in its melted state. The optically anisotropic phase has a greater specific gravity than that of the optically isotropic phase and thus quickly settles. Thus, it grows as a lower layer (i.e., a layer in the direction of the centrifugal forces). This lower layer is separated from the upper layer, and in this way the optically anisotropic and isotropic pitch parts are separated.

With this optically anisotropic pitch recovery treatment, an optically anisotropic pitch according to the invention, with an optically anisotropic phase content of 90% or above, substantially 100%, can be obtained in a short period of time and economically.

The optically anisotropic pitch obtained in the above way, may be melt spun in a well-known manner to obtain pitch fibers. These pitch fibers may be rendered infusible, then carbonized and, in some cases, further graphitized. In this way, it is possible to obtain in a stable fashion and readily pitch-based carbon fibers and graphitized carbon fibers, which have excellent properties of being rendered infusible and carbonized, satisfactory spinning stability and high performance and particularly have high compressive strength.

EXAMPLES

Examples of the invention will now be given without any sense of limiting the invention.

Example 1

Tarry substance produced as a by-product in a catalytic cracking of petroleum oil, was used as material for thermal cracking-polycondensation reaction to obtain a pitch containing about 50% of optically anisotropic phase. This pitch was subjected to centrifugal separation using a centrifugal separator to obtain a pitch "A" principally composed of an optically isotropic phase and an optically anisotropic phase pitch "B" composed of 100% optically anisotropic phase.

The pitch "A" was composed of 90% by weight n-heptane insoluble component, 63% by weight benzene insoluble component, 8% by weight pyridine insoluble component and 0.6% by weight quinoline insoluble component and had a softening point of 239° C., an aromatic carbon fraction (fa) of 0.86, a C/H atomic ratio of 1.64 and an optically anisotropic phase of about 5%.

This pitch "A" was pulverized and shieved to obtain particles with grain size of 250 μm or below. To this powdery pitch was added 30 ml of an n-heptane/benzene blend solvent (n-heptane: benzene=50:50) per 1 g of the pitch for extraction at room temperature for 2 hours. The resultant solution was filtered in a 5 μm filter to obtain a component insoluble to n-heptane/benzene blend solvent. Yield of the solvent insoluble component was about 50% by weight. This solvent insoluble component was a pitch "C" containing about 50% of an optically anisotropic phase.

Then, the pitch "C" was charged into a batch type centrifugal separator for centrifugal separation in a nitrogen atmosphere to obtain a liquid crystal pitch "D" composed of 100% optically anisotropic phase and an optically isotropic pitch substantially free from optically anisotropic phase.

The optically anisotropic pitch "D" was composed of 34.5% by weight benzene soluble component and 65.5% by weight benzene insoluble component. It had a Q value (i.e., the weight-average molecular weight divided by the number-average molecular weight) of 1.4, number-average molecular weights of benzene soluble and insoluble components of 750 and 1,230, respectively, a number-average molecular weight ratio of the benzene insoluble component to the benzene soluble component of 1.6, Q values of benzene soluble and insoluble components of 1.1 and 1.3, respectively, a quinoline insoluble component of 2.5% by weight, an aromatic carbon fractin (fa) of 0.88, a softening point of 297° C. and a C/H atomic ratio of 1.64.

Then, the optically anisotropic pitch "D" was charged into a spinning machine with a nozzle diameter of 0.3 mm and extruded with a plunger at a spinning temperature of 321° C.

This spinning operation could be continued at a take-out speed of 500 m/min. for more than one hour without any thread breakage, thus obtaining pitch fibers with a mean fiber diameter of about 13 μm.

The pitch fibers thus obtained were then subjected to an infusibilization treatment in an oxygen atmosphere and at 230° C. for one hour, and then their temperature was elevated up to 2000° C. in an inert gas atmosphere to obtain carbon fibers.

The obtained carbon fibers had a mean fiber diameter of 9.8 μm, a mean tensile strength of 3.5 GPa, a mean tensile modulus of elasticity of 600 GPa and a mean compressive strength of 0.70 GPa.

Comparative Example 1

The optically anisotropic pitch "B" obtained in Example 1 was composed of 34.5% by weight of benzene soluble component and 65.5% by weight of benzene insoluble component and had a Q value (weight-average molecular weight/number-average molecular weight) of 1.8, number-average molecular weights of benzene soluble and insoluble components of 600 and 1,880, respectively, a number-average molecular weight ratio of benzene insoluble component to benzene soluble component of 3.1, (1 values of benzene soluble and insoluble components of 1.2 and 1.5, respectively, a quinoline insoluble omponent content of 34% by weight, an aromatic carbon fraction (fa) of 0.89, a softening point of 287° C. and a C/H atomic ratio of 1.75.

This optically anisotropic pitch "B" was charged into the same spinning machine as in Example 1 for spinning at a spinning temperature of 325° C. to obtain pitch fibers with a mean fiber diameter of 13 μm.

The pitch fibers thus obtained were subjected to the infusibilization and carbonization treatments as in Example 1 to obtain carbon fibers, which had a mean fiber diameter of 9.9 μm, a mean tensile strength of 3.4 GPa, a mean tensile elastic modulus of 510 GPa and a mean compressive strength of 0.50 GPa.

Example 2

Naphthalene was used as material for catalytic polymerization to obtain a pitch "E". The pitch "E" was composed of 92% by weight n-heptane insoluble component, 24% by weight benzene insoluble component, 6% by weight pyridine insoluble component, 0% by weight quinoline insoluble component, a softening point of 200° C., an aromatic carbon fraction (fa) of 0.84, a C/H atomic ratio of 1.54 and an optically anisotropic phase of 0%.

This optically isotropic pitch "E" was pulverized as in Example 1 into particles with grain size of 250 μm or below. To this powdery pitch was added 30 ml of n-heptane/benzene blend solvent (n-heptane:benzene=20:80) per 1 g of the pitch for extraction at room temperature for 2 hours. The resultant solution was filtered using a 5 μm filter to obtain a component insoluble to n-heptane/benzene blend solvent. Yield of the solvent insoluble component was about 55% by weight. This solvent insoluble component was an optically anisotropic pitch "F" composed of 100% optically anistotropic phase.

This optically anisotropic pitch "F" was composed of 46.2% by weight benzene soluble component and 53.8% by weight benzene insoluble component and had a Q value (weight-average molecular weight/number-average molecular weight) of 1.5, number-average molecular weights of benzene soluble and insoluble components of 820 and 1,550, respectively, a number-average molecular weight ratio of benzene insoluble component to benzene soluble component of 1.9, Q values of benzene soluble and insoluble components of 1.2 and 1.3, respectively, a quinoline insoluble component content of 0% by weight, an aromatic carbon fraction (fa) of 0.84, a softening point of 302° C. and a C/H atomic ratio of 1.60.

The optically anisotropic pitch "F" was charged into the same spinning machine as in Example 1 for spinning at a spinning temperature of 322° C. to obtain pitch fibers with a mean fiber diameter of 13 μm.

The pitch fibers thus obtained were subjected to an infusibilization treatment by heating them up to 285° C. in an oxidizing gas atmosphere with an oxygen concentration of 60% and a nitrogen concentration of 40%, followed by temperature elevation up to 2,000° C. in an inert gas atmosphere, thus obtaining carbon fibers.

The obtained carbon fibers had a mean fiber diameter of 9.9 μm, a mean tensile strength of 3.0 GPa, a mean tensile elastic moludus of 610 GPa and a compressive strength of 0.69 GPa.

Comparative Example 2

The same naphthalene as in Example 2 was used as material for catalytic polymerization to obtian a pitch "G" composed of 100% optically anisotropic phase.

This optically anisotropic pitch "G" was composed of 38.0% by weight benzene soluble component and 62.0% by weight benzene insoluble component and had a Q value (weight-average molecular weight/number-average molecular weight) of 1.7, number-average molecular weights of benzene insoluble and soluble components of 460 and 1,850, respectively, a number-average molecular weight ratio of benzene insoluble omponent to benzene soluble component of 4.0, Q values of benzene soluble and insoluble components of 1.2 and 1.4, respectively, a quinoline insoluble component content of 35.1% by weight, an aromatic carbon fraction (fa) of 0.85, a softening point of 280° C. and a C/H atomic ratio of 1.52.

This optically anisotropic pitch "G" was charged into the same spinning machine as in Example 1 for spinning at a spinning temperature of 307° C. to obtain pitch fibers with a mean fiber diameter of 13 μm.

The pitch fibers thus obtained were subjected to the infusibilization and carbonization treatments in the same manner as in Example 2. The carbon fibers thus obtained had a mean fiber diameter of 9.5 μm, a mean tensile strength of 3.3 GPa, a mean tensile elastic modulus of 580 GPa and a mean compressive strength of 0.49 GPa.

Comparative Example 3

Tarry substance produced as a by-product in the catalytic cracking as in Example 1 was used as raw material for thermal cracking-polycondensation reaction to obtain an optically isotropic pitch "H" free from optically anisotropic phase.

This optically isotropic pitch "H" was composed of 78% by weight n-heptane insoluble component, 5% by weight benzene insoluble component, 3% by weight pyridine insoluble component and 1.2% by weight quinoline insoluble component and had a softening point of 120° C., an aromatic carbon fraction (fa) of 0.87 and a C/H atomic ratio of 1.39.

As in Example 1, the optically isotropic pitch "H" was pulverized into particles with a grain size of 250 μm or below, and to this powdery pitch was added 30 ml of benzene per 1 g of the pitch for extraction at room temperature for 2 hours. The resultant solution was filtered using a 5 μm filter to obtain a benzene insoluble component. Yield of the insoluble component was about 20% by weight. This solvent insoluble component was a 100% optically anistotropic phase pitch "I".

This optically anisotropic pitch "I" was composed of 42% by weight benzene soluble component and 58% by weight benzene insoluble component and had a Q value (weight-average molecular weight/number-average molecular weight) of 1.7, number-average molecular weights of benzene soluble and insoluble components of 670 and 1,650, respectively, a number-average molecular weight ratio of benzen insoluble component to benzene soluble component of 2.5, Q values of benzene soluble and insoluble components of 1.2 and 1.4, respectively, a quinoline insoluble component content of 4.8% by weight, an aromatic carbon fraction (fa) of 0.92, a softening point of 325° C. and a C/H atomic ratio of 1.88.

This optically anisotropic pitch "I" was charged into the same spinning machine as in Example 1 and spun at a spinning temperature of 350° to 370° C. In this case, thread breakage occurred greatly, and stable spinning could not be obtained.

Comparative Example 4

To the same pitch "H" as in Comparative Example 3 was added 30 ml of n-heptane/benzene blend solvent (n-heptane: benzene=75:25) per 1 g of the pitch for extraction at room temperature for 2 hours. The resultant solution was filtered using a 5 μm filter to obtain a component insoluble to n-heptane/benzene blend solvent at an yield of about 87% by weight. This solvent-insoluble component was a pitch "J" containing 40% of an optically anisotropic phase.

The pitch "J" was subjected to centrifugal separation using the same centrifugal separator as in Example 1 to obtain a 100% optically anisotropic phase pitch "K".

This optically anisotropic pitch "K" was composed of 37% by weight benzene soluble component and 63% by weight benzene insoluble component and had a Q value (weight-average molecular weight/number-average molecular weight) of 1.7, number-average molecular weights of benzene soluble and insoluble components of 580 and 1,590, respectively, a number-average molecular weight ratio of benzene insoluble component to benzene soluble component of 2.7, Q values of benzene soluble and insoluble components of 1.2 and 1.5, respectively, a quinoline insoluble component content of 5.8% by weight, an aromatic carbon fraction (fa) of 0.9, a softening point of 290° C. and a C/H atomic ratio of 1.88.

The optically anisotropic pitch "K" was charged into the same spinning machine as in Example 1 and spun at a spinning temperature of 326° C. to obtain pitch fibers with a mean fiber diameter of 13 μm.

The pitch fibers thus obtained were subjected to the infusibilization and carbonization treatments in the same manner as in Example 1. The carbon fibers thus obtained had a mean fiber diameter of 9.9 μm, a mean tensile strength of 3.0 GPa, a mean tensile elastic modulus of 480 GPa and a mean compressive strength of 0.46 GPa.

Comparative Example 5

Heavy extract oil produced through solvent extraction of petroleum oil was used as material for themal cracking-polycondensation reaction to obtain an optically isotropic pitch "L" free from optically anisotropic phase.

This optically isotropic pitch "L" was composed of 37% by weight n-heptane insoluble component, 14% by weight benzene insoluble component, 2% by weight pyridine insoluble component and 1.1% by weight quinoline insoluble component and had a softening point of 120° C., an aromatic carbon fraction (fa) of 0.70 and a C/H atomic ratio of 1.18.

As in Example 1, this optically isotropic pitch "L" was pulverized into particles with a grain size of 250 μm or below, and to this powdery pitch was added 30 ml of n-heptane/benzene blend solvent (n-heptane:benzene=50:50) per 1 g of the pitch for extraction at room temperature for 2 hours. The resultant solution thus obtained was filtered using a 5 μm filter to obtain a component insoluble to n-heptane/benzene blend solvent. Yield of the solvent insoluble component was about 33% by weight. This solvent insoluble component was an optically anisotropic pitch "M" containing 98% of an optically anisotropic phase.

This optically anisotropic pitch "M" was composed of 34% by weight benzene soluble component and 66% by weight benzene insoluble component and had a Q value (weight-average molecular weight/number-average molecular weight) of 3.8, number-average molecular weights of benzene soluble and insoluble components of 680 and 2,400, respectively, a number-average molecular weight ratio of benzene insoluble component to benzene soluble component of 3.5, Q values of benzene soluble and insoluble components of 1.4 and 2.0, respectively, a quinoline insoluble component content of 3.2% by weight, an aromatic carbon fraction (fa) of 0.81, a softening point of 306° C. and a C/H atomic ratio of 1.52.

This optically anisotropic pitch "M" was charged into the same spinning machine as in Example 1 and spun at a spinning temperature of 340° to 360° C. In this case, thread breakage occurred greatly, and stable spinning could not be obtained.

As has been described in the foregoing, the optically anisotropic pitch according to the present invention has the following features:

(1) Since it is obtainable from a material pitch having a specific characteristic substantially without thermal reaction but by carrying out removal of low molecular weight components and generation and separation of the optically anisotropic phase, it has a pitch composition not obtainable through prior art thermal reaction, an adequate number-average molecular weight and a narrow molecular weight distribution with low and high molecular weight components being less contained.

(2) Since the characteristic of the material pitch is specified, it is possible to obtain a low softening point and a high yield, which could not have been attained with the prior art solvent extraction process.

(3) By selecting the characteristic of the material pitch and conditions for the solvent extraction, it is possible to control the characteristic of the optically anisotropic pitch to a certain extent.

Thus, with the optically anisotropic pitch according to the present invention it is possible to obtain carbon fibers having high compressive strength which could not have been obtained with prior art techniques. In addition, the optically anisotropic pitch according to the invention is capable of stable spinning continuously for a long time, thus permitting improvement of the carbon fiber productivity.

Further, the carbon fibers obtainable according to the invention has high compressive strength as well as high tensile strength and tensile elastic modulus.

We claim:

1. An optically anisotropic pitch for manufacturing high compressive strength carbon fibers, said pitch containing a benzene soluble component and a benzene insoluble component, and having a Q value of 1.6 or below, a number-average molecular weight ratio of said benzene insoluble component to said benzene soluble component of 1.9 or below, an aromatic carbon fraction of 0.8 or above, a C/H atomic ratio of 1.85 or below, an optically anisotropic phase of 90% or above, a quinoline insoluble component of 5% by weight or below, and a softening point of 320° C. or below.

2. The optically anisotropic pitch for manufacturing high compressive strength carbon fibers according to claim 1, wherein each of said benzene insoluble component and benzene soluble component has a Q value of 1.4 or below.

3. The optically anisotropic pitch for manufacturing high compressive strength carbon fibers according to claim 1, which has an aromatic carbon fraction (fa) of 0.8 to 0.9.

4. The optically anisotropic pitch for manufacturing high compressive strength carbon fibers according to claim 1, which has a C/H atomic ratio of 1.55 to 1.80.

5. A method of manufacturing high compressive strength carbon fibers comprising the steps of melt spinning the optically anisotropic pitch according to claim 1, infusibilizing said spun pitch fibers, and carbonizing or graphitizing said infusibilized fibers.

6. A method of manufacturing high compressive strength carbon fibers comprising the steps of melt spinning the optically anisotropic pitch according to claim 2, infusibilizing said spun pitch fibers, and carbonizing or graphitizing said infusibilized fibers.

7. A method of manufacturing high compressive strength carbon fibers comprising the steps of melt spinning the optically anisotropic pitch according to claim 3, infusibilizing said spun pitch fibers, and carbonizing or graphitizing said infusibilized fibers.

8. A method of manufacturing high compressive strength carbon fibers comprising the steps of melt spinning the optically anisotropic pitch according to claim 4, infusibilizing said spun pitch fibers, and carbonizing or graphitizing said infusibilized fibers.

* * * * *